United States Patent [19]

Lizenby et al.

[11] Patent Number: 4,656,002

[45] Date of Patent: Apr. 7, 1987

[54] SELF-SEALING FLUID DIE

[75] Inventors: James R. Lizenby; Kevin J. Lizenby, both of Traverse City; L. James Barnard, Williamsburg, all of Mich.

[73] Assignee: ROC-Tec, Inc., Traverse City, Mich.

[21] Appl. No.: 783,555

[22] Filed: Oct. 3, 1985

[51] Int. Cl.[4] ..... B22F 1/00

[52] U.S. Cl. ..... 419/10; 264/65; 264/570; 419/42; 419/49; 419/56; 419/68; 425/78; 425/387.1; 425/405 R; 425/405 H

[58] Field of Search ..... 419/42, 68, 49, 10, 419/56; 425/78, 387.1, 405 R, 405 H; 264/DIG. 5, 56, 65

[56] References Cited

U.S. PATENT DOCUMENTS

| | | | |
|---|---|---|---|
| Re. 31,355 | 8/1983 | Rozmus | 419/48 |
| 3,729,931 | 5/1973 | Gurganus et al. | 419/42 |
| 3,992,200 | 11/1976 | Chandhok | 419/49 |
| 4,041,123 | 8/1977 | Lange et al. | 419/49 |
| 4,112,143 | 9/1978 | Adlerborn | 419/49 |
| 4,428,906 | 1/1984 | Rozmus | 419/48 |
| 4,547,337 | 10/1985 | Rozmus | 419/49 |
| 4,568,516 | 2/1986 | Adlerborn et al. | 419/42 |

*Primary Examiner*—Stephen J. Lechert, Jr.
*Attorney, Agent, or Firm*—Harold W. Milton, Jr.

[57] ABSTRACT

A preformed body (12) from powder material of metallic and nonmetallic compositions and combinations thereof, is consolidated to form a densified compact (12'') of a predetermined density. An outer container mass (20), capable of fluidity in response to predetermined forces and temperatures and which is porous to gases at lesser temperatures and forces than said predetermined force and temperature, surrounds an internal medium (22). The internal medium encapsulates the preformed body (12) within the container mass (20) and is capable of melting at the lesser temperatures to form a liquid barrier to gas flow therethrough. The internal medium (22) is capable of rapid hermetic sealing during the early stages of preheat. External pressure is applied by a pot die (16) and ram (14) to the entire exterior of the container mass (20) to cause the predetermined densification of the preformed body (12) by hydrostatic pressure.

15 Claims, 2 Drawing Figures

SELF-SEALING FLUID DIE

TECHNICAL FIELD

The subject invention is used for consolidating preformed bodies from powder material of metallic and nonmetallic compositions and combinations thereof to form a predetermined densified compact.

BACKGROUND ART

It is well known to vacuum sinter preformed bodies from compacted powders. However, even at high temperatures and prolonged sintering times, full theoretical densities are rarely accomplished. Furthermore, the resulting grain and microconstituent sizes are so large as to substantially reduce desired performance.

It is also well known to sinter and hot isostatically press preformed bodies from compacted powders. In addition to the expense of both operations, high temperatures and long cycle times again produce large grain and microconstituent sizes.

Significant developments have been made as disclosed in the U.S. Pat. No. 4,428,906 to Rozmus, issued Jan. 31, 1984 wherein the preformed bodies can be placed or cast into a mold comprised of a pressure-transmitting medium, which, in turn, is comprised of a rigid interconnected ceramic skeleton structure which encapsulates a fluidizing glass.

The glass becomes fluidic and capable of plastic flow at temperatures utilized for compaction whereas the ceramic skeleton retains its configuration and acts as a carrier for the fluidic glass. As external pressure is applied by coaction between a pot die and ram, the ceramic skeleton structure collapses to produce a composite of ceramic skeleton structure fragments dispersed in the fluidizing glass with the composite being substantially fully dense and incompressible and rendered fluidic and capable of plastic flow at the predetermined densification of the material being compacted within the container. Accordingly, the ceramic skeleton structure is dominant to provide structural rigidity and encapsulation and retainment of the fluidic glass until the skeleton structure is collapsed under ram pressure and the fluidizing glass becomes dominant to provide omnidirectional pressure transmission to effect the predetermined densification of the preformed body being compacted. The resultant high pressure (in excess of 120,000 psi) of a forge press enables full theoretical density consolidation at significantly lower time at lower temperatures. This produces very fine grain and intermetallic sizes and superior product performance.

However, since it is expensive and difficult for most shapes to can, the preformed body is subject to contamination during preheat by furnace atmosphere gases and reaction gases of the pressure-transmitting medium resulting in unacceptable surfaces, and poor microstructures and physical properties.

STATEMENT OF THE INVENTION

In accordance with the present invention, there is provided an assembly for consolidating a preformed body from a powdered material of metallic and nonmetallic compositions and combinations thereof to form a densified compact of a predetermined density. The assembly includes an outer container mass capable of fluidity in response to predetermined forces and temperatures and which is porous to gases at lesser temperatures and forces than the predetermined forces and temperatures and an internal medium encapsulating the preformed body within the container mass for melting at the lesser temperatures and forces to form a liquid barrier to gas flow therethrough. The instant invention further provides a method of consolidating a preformed body from a powdered metal material of metallic and nonmetallic compositions and combinations thereof into a densified compact of a predetermined density. The method includes the steps of surrounding the preformed body with a container mass capable of fluidity in response to predetermined forces and temperatures and porous to the flow of gases therethrough at lesser temperatures and forces than said predetermined forces and temperatures and encapsulating the preformed body in an internal medium within the container mass and melting the internal medium at the lesser temperatures to form a liquid barrier to gas flow therethrough.

FIGURES IN THE DRAWING

Other advantages of the present invention will be readily appreciated as the same becomes better understood by reference to the following detailed description when considered in connection with the accompanying drawings wherein:

FIG. 1 is a cross-sectional view of an assembly constructed in accordance with the instant invention; and FIG. 2 is a cross-sectional view of the same assembly shown in FIG. 1 but shown under compaction conditions.

DETAILED DESCRIPTION OF THE DRAWINGS

Figure 1:
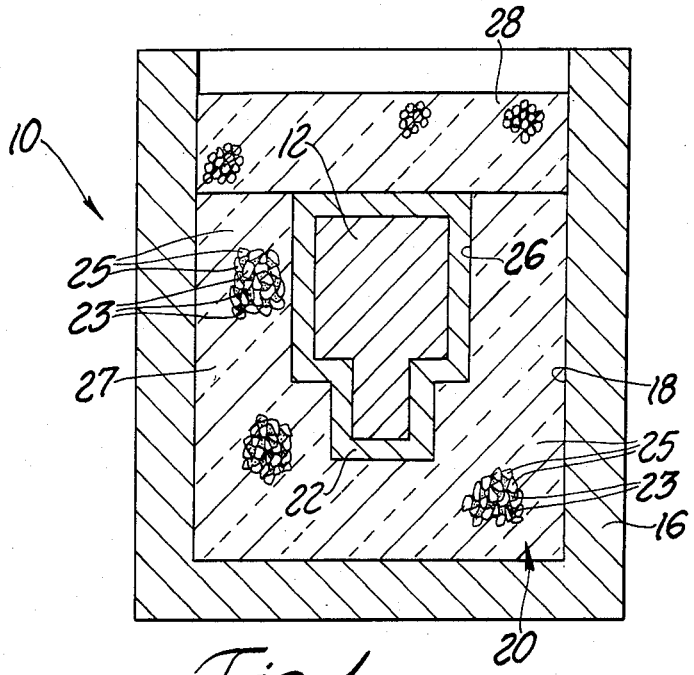
Figure 2:
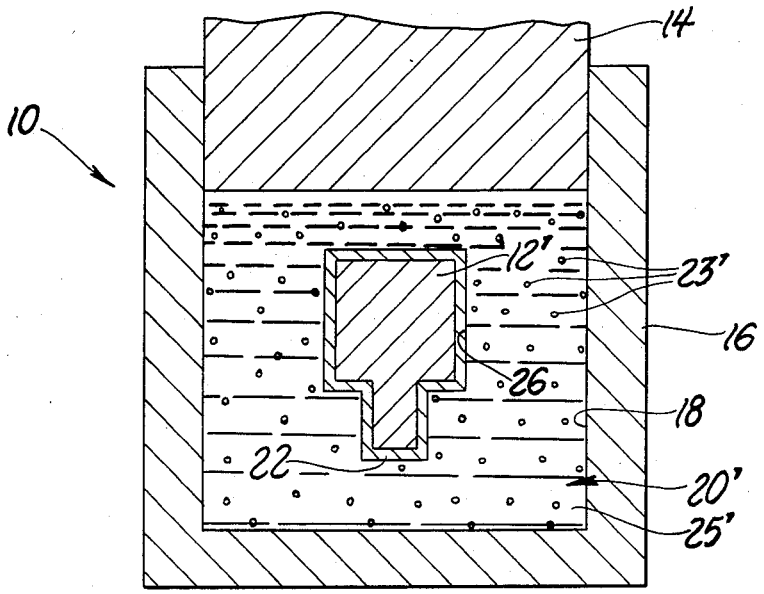

An assembly for consolidating a preformed body 12 constructed in accordance with the instant invention is generally shown at 10 in the FIGURES. The assembly 10 is for consolidating a preformed body 12 from a powdered material of metallic and nonmetallic compositions and combinations thereof including fully dense segments, to form a densified compact 12' of a predetermined density. The preformed body 12 is known as a green part which has compacted to a low density prior to being surrounded as shown in FIG. 1, for example, it has been rendered self-supporting to a predetermined shape.

The assembly 10 includes a ram 14 and pot die 16 of a press. The lower pot die 16 receives the assembly 10 in a pocket 18 to restrain the assembly 10.

The assembly 10 includes an outer container mass 20 capable of fluidity in response to predetermined forces and temperatures and which is porous to gases at lesser temperatures and forces than the predetermined forces and temperatures. The assembly is characterized by including an internal medium 22 encapsulating the preformed body 12 within the container mass 20 for melting at the lesser temperatures to form a liquid barrier to the flow of gases therethrough.

More specifically, the outer container mass 20 may include a rigid interconnected skeleton structure as disclosed in the U.S. Pat. No. 4,428,906 to Rozmus, issued Jan. 31, 1984, and assigned to the assignee of the instant invention. The outer container mass 20 is a pressure-transmitting medium which includes a rigid interconnected skeleton structure 23 which is collapsible in response to the predetermined forces or pressure and further includes fluidizing means 25 capable of fluidity and supported by and retained within the skeleton structure 23 for forming a composite 20' of skeleton structure fragments 23' dispersed in the fluidizing means 25 in response to the collapse of the skeleton structure 23 at the predetermined forces and for rendering the composite 20' substantially fully dense and incompressible and capable of fluidic flow at the predetermined density of the compact 12'. The skeleton structure may comprise ceramic and the fluidizing means 25 may comprise glass.

The internal medium 22 may be made from various materials capable of melting at lesser temperatures than those for densification. Preferably, the material comprising the medium 22 is of lower viscosity at the predetermined temperatures than the outer container mass 20. A preferred medium 22 is glass capable of melting at lesser temperatures than the glass defining the fluidizing means 25 of the container mass 20.

The outer container mass 20 includes a preformed cup 27 defining a cavity 26 for receiving the internal medium 22 therein. The outer container mass 20 further includes a cover 28 for covering the cavity 26 and the cup 27.

The instant invention further provides a method of consolidating the preformed body 12 from a powdered metal material of metallic and nonmetallic compositions and combinations thereof to form a densified compact 12' of a predetermined density. The method comprises the steps of surrounding the preformed body 12 with a container mass 20 capable of fluidity in response to predetermined forces and temperatures and porous to the flow of gases therethrough at lesser temperatures and forces than the predetermined forces and temperatures; encapsulating the preformed body 12 in an internal medium 22 within the container mass 20 and at an early stage during preheat melting the internal medium 22 at the lesser temperatures to form a liquid barrier to gas flow therethrough, thus, precluding furnace atmosphere gases and reactive gases of the outer container mass 20 from contaminating the preform body 12. External pressure is applied to the entire exterior of the container mass 20 to cause the predetermined densification of the preformed body 12 into the compact 12' by hydrostatic pressure applied by the container mass 20 and medium 22 being fully dense and incompressible and capable of fluidic flow at least just prior to the predetermined densification of the compact 12'. The container mass 20 is of a rigid interconnected skeleton structure which is collapsible in response to the predetermined force and fluidizing means capable of fluidity and supported by and retained within the skeleton structure for forming a composite 20' of skeleton structure fragments dispersed in the fluidizing means in response to the collapse of the skeleton structure at the predetermined force and for rendering the composite 20' substantially fully dense and incompressible and capable of fluidic flow at the predetermined density of the compact 12'. Preferably, the internal medium 22 is of glass as is the fluidizing means. Both may be the same glass frit. The container mass 20 is formed of a cup 27 with a cavity 18 receiving the internal medium 22 and cover means 28 to cover the cavity 18 and container mass 20. The container mass 20 is placed with the internal medium 22 and preformed body 12 therein into a pot die 16. A ram 14 is inserted into the pot die 16 to compress the container mass 20 therein to apply the predetermined force to the container mass 20 while restrained within the pot die 16. The preformed body 12 and internal medium is heated prior to placement into the pot die 16, preferably in a furnace.

The two-part container 27, 28 is cast and cured to form the composite ceramic-glass die. Although the preformed body 12 can be placed on a slender wire support to keep it from settling to the bottom of the cavity 26 during preheat and consolidation, the preferred method is to layer a mixture of glass powder (the preferred hermetic sealing medium) and silica on the bottom of the cavity 26 to the desired height of placement of the preformed body 12. The silica-glass mixture precludes the preformed body 12 from settling all the way to the cavity bottom. After placing the preformed body 12 on the silica glass layer, the balance of the cavity is filled with glass powder to form the medium 22. The pressure-transmitting cover 28 is placed on top, as shown in FIG. 1. The assembly is placed in an atmosphere-controlled furnace which is already at, or above, consolidation temperature. Within minutes, the low melting medium 22 provides a barrier to protect the preformed body 12 from gas contamination. At temperatures above the consolidation temperature, the higher temperature provides faster hermetic sealing and also shorter preheat cycle. If the temperature is above consolidated temperature, the cycle must be timed so that the container 20 is removed when the preformed body 12 reaches the temperature of consolidation. The container mass 20 is placed in the pot die 16 and compressed by the ram 14. The container 20' is then removed, cooled down and mechanically stripped. The preferred hermetic sealing medium is glass, but it could be metal, salt or polymers, depending on the process temperatures. The composite 20' solidifies as the glass cools and may be fractured for removal, i.e., broken away.

If the hermetic sealing medium 22 is reactive with the preformed body 12 or so low in viscosity as to penetrate surface pores in the preformed body 12 when pessure is applied, the preformed body 12 can be pre-coated with a nonreactive, relatively impermeable, higher temperature coating such as Delta Glaze 27. Such a coating would render the preformed body 12 impermeable to the molten medium.

In operation, the preformed body 12, encapsulated in the internal medium 22 and contained within the pressure-transmitting container mass 20 is preheated and, in turn, placed in the pot die 16. Forces are applied to the entire exterior surface of the container mass 20 by the ram 14 compressing same in the pot die 16 to densify the preformed body 12 into a compact 12' of predetermined density. The rapid hermetic sealing medium 22 melts at a relatively low temperature thereby forming a gas diffusion barrier during the preheat phase, i.e., a liquid barrier to prevent the passage of gases therethrough. At an early stage of preheat, the hermetic sealing medium melts sufficiently to preclude furnace atmosphere gases and reactive gases from the pressure-transmitting container mass 20 from contaminating the preformed body 12. As external pressure is applied by the coaction between the pot die 16 and ram 14, the ceramic skeleton structure of the pressure-transmitting container mass 20 collapses to produce a composite 20' of ceramic skeleton structure fragments 23' dispersed in the fluidizing glass 25' with the composite being substantially fully dense and incompressible and rendered fluidic and capable of plastic flow at the predetermined densification of the compact 12' being compacted within the container. The hermetic sealing medium 22, being substantially melted, and fully dense under the pressure, does not deter the plastic flow pressure transmission. Accordingly, the ceramic skeleton structure is dominant to provide structural rigidity and encapsulation and retainment of the fluidic gas until the skeleton structure is collapsed under the forces of the ram 14 and becomes dominant to provide omnidirectional pressure transmission to effect the predetermined densification of the compacted body 12'.

The invention has been described in an illustrative manner, and it is to be understood that the terminology which has been used is intended to be in the nature of words of description rather than of limitation.

Obviously, may modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An assembly (10) for consolidating a preformed body (12) from a powder material of metallic and nonmetallic compositions and combinations thereof to form a densified compact (12') of a predetermined density, said assembly (10) comprising; an outer container mass (20) capable of fluidity in response to predetermined forces and temperatures and which is porous to the flow of gases therethrough at lesser temperatures and forces than said predetermined forces and temperatures; and characterized by an internal medium (22) encapsulating the preformed body (12) within said container mass (20) for melting at said lesser temperatures to form a liquid barrier to gas flow therethrough.

2. An assembly as set forth in claim 1 characterized by said outer container mass (20) including a rigid interconnected skeleton structure which is collapsible in response to said predetermined force and fluidizing means capable of fluidity and supported by and retained within said skeleton structure for forming a composite (20') of skeleton structure fragments dispersed in said fluidizing means in response to the collapse of said skeleton structure at said predetermined force and for rendering said composite (20') substantially fully dense and incompressible and capable of fluidic flow at the predetermined density of said compact (12').

3. An assembly as set forth in claim 2 further characterized by said internal medium (22) comprising glass.

4. An assembly as set forth in claim 3 further characterized by said fluidizing means comprising glass.

5. An assembly as set forth in claim 1 further characterized by said internal medium (22) being of lower viscosity at said predetermined forces and temperatures than said outer container mass (20).

6. An assembly as set forth in claim 5 further characterized by said outer container mass (20) including a preformed cup (27) defining a cavity (18) for receiving said internal medium (22) therein, and cover means (28) for covering said cavity (18).

7. An assembly as set forth in claim 6 further characterized by a pot die (16) for receiving said container mass (20) and a ram (14) for applying said predetermined force to said container mass (20) while restrained within said pot die (16).

8. A method of consolidating a preformed body (12) from a powder material of metallic and nonmetallic compositions and combinations thereof to form a densified compact (12') of a predetermined density, said method comprising the steps of:

surrounding the preformed body (12) with a container mass (20) capable of fluidity in response to predetermined forces and temperatures and porous to the flow of gases therethrough at lesser temperatures and forces than said predetermined forces and temperatures;

encapsulating the preformed body (12) in an internal medium (22) within the container mass (20) and melting the internal medium (22) at said lesser temperatures to form a liquid barrier to gas flow therethrough.

9. A method as set forth in claim 8 further characterized by applying external pressure to the entire exterior of the container mass (20) to cause the predetermined densification of the preformed body (12) into the compact (12') by hydrostatic pressure applied by the container mass (20) and medium (22) being fully dense and incompressible and capable of fluidic flow at least just prior to the predetermined densification of the compact (12').

10. A method as set forth in claim 9 further characterized by forming the container mass (20) of a rigid interconnected skeleton structure which is collapsible in response to said predetermined force and fluidizing means capable of fluidity and supported by and retained within the skeleton structure for forming a composite (20') of skeleton structure fragments dispersed in said fluidizing means in response to the collapse of the skeleton structure at the predetermined force and for rendering the composite (20') substantially fully dense and incompressible and capable of fluidic flow at the predetermined density of the compact (12').

11. A method as set forth in claim 10 further characterized by forming the internal medium (22) of glass.

12. A method as set forth in claim 11 further characterized by forming the fluidizing means of glass.

13. A method as set forth in claim 10 further characterized by forming the container mass (20) of a cup (27) with a cavity (18) receiving the internal medium (22) and cover means (28) covering the cavity (18) and container mass (20).

14. A method as set forth in claim 13 further characterized by placing the container mass (20) with the internal medium (22) and preformed body (12) therein into a pot die (16) and inserting a ram (14) into the pot die (16) to compress the container mass (20) therein to apply the predetermined force to the container mass (20) while restrained within the pot die (16).

15. A method as set forth in claim 14 further characterized by heating the performed body (12) and internal medium prior to placement into the pot die (16).

* * * * *